US005976265A

United States Patent [19]

Sangeeta et al.

[11] Patent Number: 5,976,265

[45] Date of Patent: Nov. 2, 1999

[54] METHOD FOR REMOVING AN ALUMINIDE-CONTAINING MATERIAL FROM A METAL SUBSTRATE

[75] Inventors: D. Sangeeta, Niskayuna; Leo Spitz MacDonald, Petersburgh, both of N.Y.

[73] Assignee: General Electric Company, Schenectady, N.Y.

[21] Appl. No.: 09/067,780

[22] Filed: Apr. 27, 1998

[51] Int. Cl.[6] ..... C23G 1/02; B08B 3/00; C09D 9/00; C11D 14/02

[52] U.S. Cl. ..... 134/3; 134/41; 134/28; 510/201; 510/202; 510/269

[58] Field of Search ..... 134/3, 41, 28; 510/207, 202, 269

[56] References Cited

U.S. PATENT DOCUMENTS

| | | | |
|---|---|---|---|
| 3,373,114 | 3/1968 | Grunwald | 134/3 |
| 3,458,353 | 7/1969 | Baldi | 134/3 |
| 3,607,398 | 9/1971 | Lucas | 134/3 |
| 3,622,391 | 11/1971 | Baldi | 134/3 |
| 3,779,879 | 12/1973 | Scott . | |
| 3,833,414 | 9/1974 | Grisik et al. | 134/41 |
| 3,922,390 | 11/1975 | Otrhalek et al. | 427/162 |
| 4,025,359 | 5/1977 | Connelly, Jr. | 134/3 |
| 4,339,282 | 7/1982 | Lada et al. . | |
| 4,425,185 | 1/1984 | Fishter et al. . | |
| 5,441,574 | 8/1995 | Hansen et al. . | |

FOREIGN PATENT DOCUMENTS

| | | |
|---|---|---|
| 2115013 | 1/1983 | United Kingdom . |

*Primary Examiner*—Jill Warden
*Assistant Examiner*—Yolanda E. Wilkins
*Attorney, Agent, or Firm*—Noreen C. Johnson; Douglas E. Stoner

[57] ABSTRACT

A process for selectively removing an aluminide-containing coating from the surface of a metal-based substrate is disclosed. It includes the following steps:

(a) contacting the surface of the substrate with at least one stripping composition to degrade the coating without severely pitting the substrate, wherein the stripping composition is selected from the group consisting of: (i) aliphatic or aromatic sulfonic acids; (ii) a solution of an inorganic acid and an organic solvent; and (iii) sulfuric acid or an aqueous solution of sulfuric acid; and then (b) removing the degraded coating without damaging the substrate.

36 Claims, 1 Drawing Sheet

METHOD FOR REMOVING AN ALUMINIDE-CONTAINING MATERIAL FROM A METAL SUBSTRATE

TECHNICAL FIELD

This invention relates generally to metallurgical processes. More specifically, it is directed to treating processes for metal-based substrates.

BACKGROUND OF THE INVENTION

A variety of specially-formulated coatings are often used to protect metal parts which are exposed to high temperatures, e.g., metal parts made from superalloys. For example, aluminide coatings are often used to provide oxidation-and corrosion-resistance to superalloys. Sometimes, the aluminide coatings serve as a bond layer between the superalloy substrate and a thermal barrier coating (TBC), e.g., a coating based on a ceramic material like zirconia.

Some of the aluminide coatings are often referred to as "diffusion coatings" because the aluminide material is diffused into the substrate surface. In one such process, a very thin layer of platinum (e.g., about 1–6 microns) is first applied to the substrate surface by electroplating. The aluminide material is then usually applied by a vapor deposition process. For example, a mixture of alumina and an ammonium halide can be heated to form an aluminum halide such as aluminum fluoride. The aluminum halide is then chemically reduced to aluminum, which is diffused into the substrate surface. The aluminum reacts with the platinum and with the substrate material (e.g., nickel) to form a variety of intermetallic compounds, such as platinum aluminide and nickel aluminide. A reaction-diffusion zone usually forms below the aluminide region. Upon oxidation exposure, an aluminum oxide film forms on the surface of the aluminide. The oxide film serves as the primary barrier against further reactions with environmental constituents, thereby maintaining the integrity of the substrate. If the aluminum oxide film spalls or becomes damaged during use, the underlying, exposed aluminide is then usually re-oxidized, preserving the protective barrier.

It is sometimes necessary to repair the aluminide coating. For example, coatings applied on turbine engine parts are frequently repaired when the turbine itself is overhauled. The repair process can involve various steps, including stripping of the aluminide coating, and deposition of a new aluminide coating in the affected area. In current practice, the aluminide materials are often stripped from the substrate by exposure to various acids or combinations of acids, e.g., hydrochloric acid, nitric acid, and phosphoric acid.

There are some drawbacks associated with the use of the various stripping compositions mentioned above. Frequently, the overall procedure is time-consuming, requiring as much as 4–6 hours of contact time with the stripping compositions and with rinsing solutions. Moreover, some of the stripping compositions do not remove sufficient amounts of the aluminide material, and further time and effort is required to complete the removal. Furthermore, some of the compositions that do sufficiently remove the aluminides also attack the base metal of the substrate, pitting the base metal substrate or damaging the metal via intergranular boundary attack.

Furthermore, many of the currently-used stripping compositions have to be used at elevated temperatures, e.g., above about 75° C. Operation at these temperatures can attack masking materials which are used to protect selected portions of the part, e.g., airfoil roots or internal surfaces, while also raising energy costs and potentially requiring additional safety precautions.

Moreover, some of the prior art processes require heavy grit-blasting prior to treatment, to roughen the substrate surface. They also often require heavy grit-blasting after exposure to the stripping compositions. These steps can be very time-consuming, and can also damage the substrate, thereby limiting part life.

It is thus apparent that new processes for removing aluminide-based materials from metal substrates would be welcome in the art. The processes should be capable of removing substantially all of the aluminide material, while not attacking the base metal. Moreover, it would be desirable if the processes could be carried out at lower temperatures than those associated with the prior art. It would also be desirable if the processes could simplify the subsequent re-coating procedure, e.g., by eliminating preliminary steps like grit-blasting, or by greatly decreasing the force required for any grit-blasting step.

SUMMARY OF THE INVENTION

The improvements envisioned above have been substantially obtained by the discovery which forms the basis for the present invention. In one aspect, this invention relates to a method for selectively removing an aluminide-containing coating from the surface of a metal-based substrate. As used herein, "selective removal" of the aluminide coating refers to the removal of a relatively large percentage of the aluminide-containing material while removing only a very small portion (or none) of the substrate material.

The term "aluminide-containing" in this context is meant to include a variety of materials that are typically used in coating metal alloys (especially superalloys), or which are formed during or after the coating process. Non-limiting examples include aluminide itself, platinum aluminide, nickel aluminide, platinum-nickel aluminide, refractory-doped aluminides, or alloys which contain one or more of those compounds. For the sake of brevity, "aluminide-containing" will sometimes be referred to herein as simply the "aluminide" material.

The process comprises the following steps:

(a) contacting the surface of the substrate with at least one stripping composition to degrade the coating without severely pitting the substrate, wherein the stripping composition is selected from the group consisting of:
  (i) aliphatic or aromatic sulfonic acids;
  (ii) a solution of an inorganic acid and an organic solvent; and
  (iii) sulfuric acid or an aqueous solution of sulfuric acid; and then (b) removing the degraded coating without damaging the substrate.

Step (b) is often an abrasion step, e.g., using very light grit-blasting, as described below. In some embodiments, the abrasion step is preceded by an extended rinsing step, using compositions which often contain water and a wetting agent. Alternatives to abrasion for removing the degraded coating are also described below.

In some alternative embodiments for step (a), two stripping compositions are used in sequence, to initiate rapid removal of the aluminide material while also ensuring that the substrate material is substantially unaffected by any of the components in the stripping compositions.

Other details regarding the various embodiments of this invention are provided below.

DETAILED DESCRIPTION OF THE INVENTION

Figure 1:
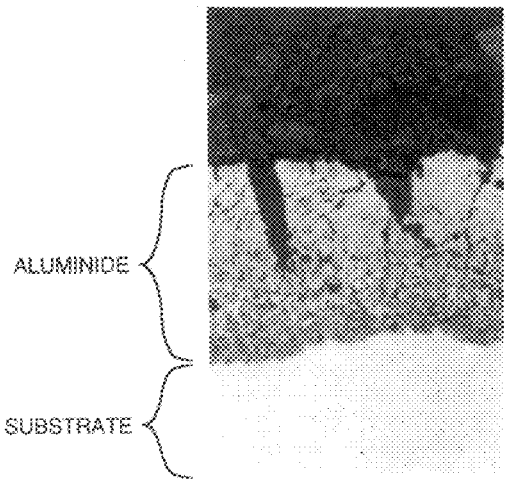
FIG. 1 is a photomicrograph of a cross-section of a platinum-aluminide coating applied on a superalloy substrate, after one stage of treatment according to this invention.

Several different classes of stripping compositions can be used in the process of this invention. The choice of a particular composition will depend on various factors, such as the type of substrate; the type of aluminide coating being removed from the substrate; the intended end use for the substrate; and the presence or absence of additional treatment steps (e.g. rinsing steps). Those skilled in the art will be able to choose the most appropriate stripping solution for a given situation, based in large part on the teachings herein.

One class of stripping compositions comprises aliphatic or aromatic sulfonic acids. Examples of suitable aliphatic sulfonic acids are methanesulfonic acid and ethanesulfonic acid, with methanesulfonic acid being preferred. Illustrative aromatic sulfonic acids are benzene sulfonic acid, toluene sulfonic acid, and naphthalene sulfonic acid.

Another class of stripping compositions (i.e., composition a(ii)) which may be used for this invention includes a solution of an inorganic acid and an organic solvent. Examples of the inorganic acid for this class of compositions are hydrochloric acid, nitric acid, and perchloric acid.

In preferred embodiments, the solvent should be one which reduces the activity and increases the wetting capability of the inorganic acid relative to the substrate. (The chemical interaction between an acid and a hydrocarbon solvent will often differ from the interaction between the acid and a solvent like water.). It has been found that the combination of the inorganic acid and the organic solvent removes substantially all of the aluminide coating material without adversely affecting the substrate. As used herein, "activity" generally refers to a measurement of the reactivity of the acid toward the substrate and/or the aluminide coating being removed from the substrate.

Examples of organic solvents which generally meet the requirements for this class of stripping compositions are aliphatic alcohols, aromatic alcohols, chlorinated alcohols, ketones, nitrile-based solvents, nitrated hydrocarbon solvents, nitrated aromatic solvents such as nitrobenzene; chlorinated hydrocarbons, amines, and mixtures of any of the foregoing.

Several specific examples of the aliphatic alcohols are methanol, ethanol, and isopropanol. Mixtures of alcohols may be used as well. Specific examples of the aromatic alcohols are phenols and substituted phenols.

The weight ratio of inorganic acid to solvent for component a(ii) is usually in the range of about 20:80 to about 80:20, and more preferably, in the range of about 35:65 to about 75:25. The specific ratio will depend on various factors, such as the type of acid and solvent(s) used; the type of substrate present; the amount and type of aluminide compound being removed from the substrate; and the reactivity (i.e., corrosion potential) of the acid. Those skilled in the art will be able to determine the most appropriate ratio, based on simple experiments and the teachings herein. One particular composition of this class comprises a mixture of hydrochloric acid and ethanol. The weight ratio of hydrochloric acid to ethanol in such a mixture is usually in the range of about 35:65 to about 65:35.

An alternative stripping composition for this invention (component a(iii)) comprises sulfuric acid or an aqueous solution of sulfuric acid. For the aqueous solution, the ratio of acid to water is usually in the range of about 10:90 to about 65:35. In preferred embodiments, the ratio is in the range of about 15:85 to about 40:60. Moreover, a wetting agent is usually used in this type of stripping composition, as described below.

The choice of a stripping agent depends on various factors, as described previously. As an example, the mixture of hydrochloric acid and ethanol (e.g., about 50/50 by weight) is very effective in removing an aluminide material from a substrate. The use of such a mixture may occasionally result in very slight pitting, or in a small amount of corrosion of the substrate. Any corrosion, however, is substantially uniform. As used herein, "uniform corrosion" refers to the removal of a very thin, continuous layer of the substrate—usually less than about 2 microns in thickness. Uniform corrosion and slight pitting are not a significant drawback for some end uses of the substrate. This is in contrast to the occurrence of severe "pitting" (often seen in the prior art), which results in holes in the substrate—often to a depth of at least about 25 microns, and usually to a depth in the range of about 25 microns to about 500 microns.

For end uses in which any pitting of the substrate is unacceptable, a different stripping composition could be employed. For example, methanesulfonic acid is effective at removing aluminide material from the substrate, although the rate of removal is not as high as in the case of HCI-alcohol. A distinct advantage of methanesulfonic acid is that its use according to this invention does not adversely affect the substrate to any substantial degree. (The uniform corrosion which may occasionally occur is still very acceptable, as described previously.) Thus, one can weigh the benefits of using one stripping composition or another, depending on the contemplated end use for the substrate.

In some embodiments, the stripping composition further includes a wetting agent. The wetting agent reduces the surface tension of the composition, permitting better contact with the substrate and the aluminide-based coating. Illustrative wetting agents are polyalkylene glycols, glycerol, fatty acids, soaps, emulsifiers, and surfactants. The wetting agent is usually present at a level in the range of about 0.1% by weight to about 5% by weight, based on the total weight of the composition.

Other additives are sometimes used in the stripping composition. For example, inhibitors are sometimes employed to lower the proton concentration, and thereby lower the activity of the acid in the composition. The lowered activity in turn decreases the potential for pitting of the substrate surface. An exemplary inhibitor is a solution of sodium sulfate in sulfuric acid, or a solution of sodium chloride in hydrochloric acid. The level of inhibitor used is usually about 1% by weight to about 15% by weight, based on the weight of the entire stripping composition.

Moreover, oxidizing agents are sometimes used in the stripping composition to prevent the formation of a reducing environment. (Some acids are reducing agents, e.g. hydrochloric acid.). Examples include peroxides (e.g., hydrogen peroxide), chlorates, perchlorates, nitrates, permanganates, chromates, and osmates (e.g., osmium tetroxide). The level of oxidizing agent used is usually about 0.01% by weight to about 5% by weight, based on the weight of the entire stripping composition.

The stripping composition may be applied to the substrate in a variety of ways. For example, it can be brushed or sprayed onto the surface. Very often, immersion of the substrate in a bath of the stripping composition is the most practical technique. The bath is preferably maintained at a temperature below about 170° F. (77° C.) while the substrate is immersed therein. In especially preferred embodiments, the bath is maintained at a temperature below about 130° F. (54° C.). The process could be carried out at room temperature, although a higher temperature range would usually be maintained, to ensure process consistency if the room temperature is variable. Higher temperatures (within the boundaries set forth above) sometimes result in more rapid removal of the aluminide coating.

In general, though, an advantage of the presently-described process is that bath temperatures are lower than those of the prior art. For example, the prior art compositions which utilized nitric acid/phosphoric acid combinations often required temperatures of above 170° F. (77° C.) to function effectively. Use of the lower temperatures according to the present method protects the masking materials which are often present, as discussed previously. The lower temperatures also represent cost savings in terms of energy usage, while also reducing some of the safety hazards associated with higher-temperature baths, e.g., in those situations where volatile components are present in the baths.

The baths containing the stripping compositions are often stirred or otherwise agitated while the process is carried out, to permit maximum contact between the stripping agent and the coating being removed. A variety of known techniques could be used for this purpose, such as the use of impellers, ultrasonic agitation, magnetic agitation, gas bubbling, or circulation-pumping. Immersion time in the bath will vary, based on many of the factors discussed above. On a commercial scale, the immersion time will usually range from about 15 minutes to about 400 minutes. In some preferred embodiments, the immersion time will be a period less than about 150 minutes. Moreover, in some especially preferred embodiments, the immersion time will be a period less than about 75 minutes.

Exposure to the stripping composition causes the aluminide coating on the surface of the substrate to become degraded. As shown in the photomicrograph referenced below, deep cracks are evident in the coating; its integrity has diminished, and its adhesion to the substrate has substantially decreased. In some embodiments, the surface is then briefly rinsed, e.g., by immersion in water or an aqueous solution for less than about 1 minute.

The degraded coating is then removed without damaging the substrate. In preferred embodiments, this step is carried out by abrading the substrate surface. In contrast to prior art processes, the present invention includes a "gentle" abrasion step which minimizes damage to the substrate. As an example, a light grit-blasting can be carried out by directing a pressurized air stream containing silicon carbide particles across the surface at a pressure of less than about 40 psi, and preferably, less than about 20 psi. Various abrasive particles may be used for the grit-blasting, e.g., metal oxide particles such as alumina, as well as silicon carbide, glass beads, crushed glass, sodium carbonate, and crushed corn cob. The average particle size should be less than about 500 microns, and preferably, less than about 100 microns.

The grit-blasting is carried out for a time period sufficient to remove the degraded coating. The duration of grit-blasting in this embodiment will depend on various factors. In the case of an aluminide coating having a deposited thickness of about 50 microns to about 100 microns, grit-blasting will usually be carried out for about 60 seconds to about 120 seconds, when utilizing an air pressure of about 20 psi to about 30 psi, and when using grit particles of less than about 100 microns. These parameters represent a suitable guideline for each of the types of stripping compositions set forth above.

Other known techniques for lightly abrading the surface may be used in lieu of grit-blasting. For example, the surface could be manually scrubbed with a fiber pad, e.g. a pad with polymeric, metallic, or ceramic fibers. Alternatively, the surface could be polished with a flexible wheel or belt in which alumina or silicon carbide particles have been embedded. Liquid abrasive materials may alternatively be used on the wheels or belts. For example, they could be sprayed onto a wheel, in a vapor honing process. (The abrasive material should be one which does not adversely affect the substrate.). These alternative techniques would be controlled in a manner that maintained a contact force against the substrate surface that was no greater than the force used in the gentle grit-blasting technique discussed above.

Other techniques could be employed in place of abrasion, to remove the degraded material. One example is laser ablation of the surface. Alternatively, the degraded material could be scraped off the surface. As still another alternative, sound waves (e.g., ultrasonic) could be directed against the surface. The sound waves, which may originate with an ultrasonic horn, cause vibrations which can shake loose the degraded material.

In some instances, the degraded coating could be removed by aggressive agitation, e.g., agitation with a force greater than that produced with the ultrasonic technique itself. For example, the substrate could be immersed in a bath which is rapidly stirred with a mechanical stirrer (i.e., for "general agitation"), and which is also ultrasonically-stirred (i.e., for "local agitation"). Agitation would be carried out until the degraded material is shaken loose.

For each of these alternative techniques, those skilled in the art would be familiar with operating adjustments which are made to control the relevant force applied to the substrate (as in the case of the abrasion technique), to minimize damage to the substrate surface.

In some optional embodiments, it is desirable to include an extended rinsing step between step (a) and step (b). This step involves contacting the degraded aluminide coating with an aqueous solution comprising water and a wetting agent like those described previously. Preferred wetting agents for this step are polyalkylene glycols like polyethylene glycol. They are usually present at a level of about 0.1% to about 5% by weight, based on the total weight of the rinsing solution. Rinsing can be carried out by a variety of techniques, but is usually undertaken by immersing the substrate in an agitated bath of the rinsing solution, for about 1 minute to about 30 minutes.

Figure 2:
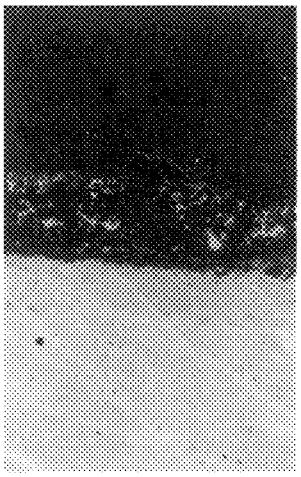
FIG. 2 is a photomicrograph of the cross-section of FIG. 1, after another stage of treatment according to some embodiments of this invention.

With reference to FIGS. 1 and 2 (which are further described below), it can be seen that the extended rinsing step removes the chunks of aluminide particles shown in the first figure. In this instance, the remaining thin layer of more coherent aluminide material is subsequently removed in an abrasion step (e.g., by grit blasting). The use of the extended rinsing step usually decreases the time required for carrying out the abrasion step. For the illustrative set of grit-blasting parameters described above, the time may be reduced to a period of about 5 seconds to about 45 seconds, for example. (The use of the alternative techniques for step (b) can result in the elimination of any abrasion step, as discussed previously.).

After grit-blasting, compressed air is usually blown across the substrate to remove any residual aluminide particles or abrasive particles. The substrate can then be re-coated with any desirable material. For example, platinum-aluminide protective coatings for engine parts can again be applied to the high-quality surface of the superalloy, which has been substantially unaffected in the earlier stages of coating repair.

In some embodiments of this invention, the substrate surface is contacted with two stripping compositions, in sequence. The first composition is one which very quickly begins to remove the aluminide materials. A specific example is the mixture of the inorganic acid and the solvent which reduces the activity of the inorganic acid relative to the substrate, as described previously. Illustrative compositions of this type are hydrochloric acid with an alcohol such as ethanol; and sulfuric acid with water.

The second stripping composition is one which is capable of removing the aluminide material more slowly, and with no pitting or attack on the substrate, except for the possible occurrence of uniform corrosion, as discussed previously. One example is the stripping composition based on an alkane sulfonic acid, such as methanesulfonic acid, as described previously.

Typically, each stripping composition is used in the form of a bath in which the substrate can be immersed. Contact times and bath temperatures will vary, based on many of the factors described previously, e.g., type and amount of aluminide material requiring removal. Usually, the first bath will be maintained at a temperature in the range of about 0° C. to about 40° C., with an immersion time between about 5 minutes and about 20 minutes. The second bath will typically be maintained at a temperature in the range of about 40° C. to about 60° C., with an immersion time between about 30 minutes and about 120 minutes.

As in previous embodiments, the surface can then be subjected to a gentle abrasion step (or similar technique) to remove the degraded coating, e.g., by light grit-blasting. Moreover, in some embodiments, the abrasion step can be preceded by an extended rinsing step, as also described above. In general, this embodiment is very useful for situations which require relatively short process times, and a high removal rate for the aluminide, without any adverse effect on the substrate. (These are also situations in which a two-stage procedure for treatment with the stripping composition would be acceptable).

The substrate on which the aluminide coating is disposed can be any metallic material or alloy which is typically protected by a thermal barrier coating. Often, the substrate is a heat-resistant alloy, e.g., a nickel-based material or cobalt-based material. Such materials are described in various references, such as U.S. Pat. No. 5,399,313 and 4,116,723, both incorporated herein by reference. High temperature alloys are also generally described in Kirk-Othmer's *Encyclopedia of Chemical Technology*, 3rd Edition, Vol.12, pp. 417–479 (1980), and Vol. 15, pp. 787–800 (1981). Illustrative nickel-base alloys are designated by the trade names Inconel®, Nimonic®, Rene® (e.g., Rene® 80-, Rene® 128, Rene® 142, and Rene® N5 alloys), and Udimet®. The type of substrate can vary widely, but it is often in the form of a jet engine part, such as an airfoil component. As another example, the substrate may be the piston head of a diesel engine, or any other surface requiring a heat-resistant barrier coating with a substantially smooth surface.

EXAMPLES

The examples which follow illustrate some embodiments of this invention, and should not be construed to be any sort of limitation on its scope.

Each test sample was a button made from a nickel-based superalloy, Rene® N-5, having a thickness of 0.125 inch (0.32) cm, and a diameter of 1 inch (2.4 cm). Prior to deposition of the aluminide coating, the buttons were grit-blasted with alumina and cleaned. The surface of each button was electroplated with platinum to a depth of about 7.5 microns, followed by diffusion-aluminiding of the surface to a depth of about 50 microns.

Example 1

Sample 1 was treated according to a prior art process, involving two steps which included stripping compositions. In the first step, one of the buttons was immersed in a bath formed from a 50:50 (by weight) mixture of nitric acid and phosphoric acid. The bath was maintained at a temperature of about 170° F. to 190° F. (77–88° C.). After 2–4 hours, the sample was removed from the bath and rinsed in water for 20 minutes. The button was then immersed in a bath of 20–40% (by weight) hydrochloric acid in water, maintained at about 150–165° F. (66–74° C.). The immersion time for the second bath was about 30–60 minutes. After removal from the second bath, the sample was rinsed again in water for about 20 minutes, and then examined.

Example 2

Sample 2 was treated according to one embodiment of the present invention. One of the buttons was immersed in a bath formed from a 50:50 (by weight) mixture of methanesulfonic acid and water. The bath was maintained at a temperature of 120° F. (49° C.). After 45 minutes, the button was removed from the bath and rinsed in water for 20 minutes. The button was then gently grit-blasted. The grit-blasting was carried out by directing a pressurized air stream containing silicon carbide particles across the button surface at a pressure of about 20 psi. The silicon carbide particles had an average particle size of less than 50 microns. The button was then examined.

Example 3

Sample 3 was treated according to another embodiment of the present invention. One of the buttons was immersed in a bath formed from a 50:50 (by weight) mixture of hydrochloric acid (37.7 wt. % in water) and ethanol. The bath was maintained at a temperature of 120° F. (49° C.). After 45 minutes, the button was removed from the bath and rinsed in water for 20 minutes. The button was then gently grit-blasted. The grit-blasting was carried out according to the specifications for sample 2. The button was then examined.

Example 4

Sample 4 was treated according to another embodiment of the present invention. One of the buttons was immersed in a bath of 25% (by weight) sulfuric acid in water. The bath was maintained at a temperature of 120° F. (49° C.). After 30 minutes, the button was removed from the bath and rinsed in water for 20 minutes. The button was then gently grit-blasted according to the specifications for sample 2, and examined.

Example 5

Sample 5 was treated according to still another embodiment of this invention, utilizing two different stripping compositions. A button, as described previously, was first immersed in a bath formed from a mixture of hydrochloric acid and ethanol, as in Example 3. The bath was maintained at a temperature of 77° F. (25° C.). After 10 minutes, the button was removed from the bath and rinsed in water for 20 minutes. The button was then immersed in a bath of methanesulfonic acid and water, as described in Example 2. The bath was maintained at a temperature of 73° F. (23° C.). After 45 minutes, the button was removed from the bath and rinsed in water for 20 minutes. The button was then gently grit-blasted, as described in the previous examples, and examined.

The process parameters and results are set forth in Table 1. "Selectivity" is defined as the ratio of the amount of coating material lost to the amount of substrate material lost during the stripping step(s). A higher ratio is a desirable indication that the aluminide coating material is being removed while minimizing the removal of any of the substrate material.

TABLE 1

| Sample # | Stripping Composition | Selectivity[a] | Evidence of Pitting or IGA* | Time** (min) | Temp.*** (° C.) |
|---|---|---|---|---|---|
| 1[c] | HNO3-H3PO4/HCl-Water[b] | 14 | Observed | 150–300[d] | 77–88 |
| 2 | Methane-Sulfonic Acid | 5 | None | 45 | 49 |
| 3 | HCl-Ethanol | 50 | Very Slight | 45 | 49 |
| 4 | Sulfuric Acid | 15 | Slight | 30 | 49 |
| 5 | HCl-Ethanol/MSA[b] | 42 | None | 45 | 49 |

([a]) Grams coating material removed/grams substrate material removed
([b]) 2-step stripping process; MSA = methanesulfonic acid
([c]) Comparative example
([d]) Total immersion time
*IGA = intergranular attack
**Immersion time in bath of stripping composition
***Bath temperature The above results demonstrate the advantages of various embodiments of the present invention. The process of Example 1 (i.e., sample 1), which represents the prior art, effectively removed the aluminide coating, but also resulted in a significant amount of pitting and intergranular attack of the substrate surface. Moreover, the time required for the process was excessively lengthy. In contrast, the processes for Examples 2–4 (samples 2–4) required much less time, and utilized much lower temperatures. The process of Example 5 (sample 5), utilizing the two-step stripping procedure according to some embodiments of this invention, also provided excellent coating removal and selectivity, with no adverse effects on the substrate surface.

FIG. 1 is a photomicrograph of a cross-section of a platinum-aluminide coating applied on a nickel-based superalloy substrate, after treatment with a methanesulfonic acid stripping composition according to this invention. Degradation of the layer of platinum-aluminide material is clearly apparent.

FIG. 2 is a photomicrograph of the cross-section of FIG. 1, after the degraded coating has been immersed in a rinsing composition of water and polyethylene glycol (1% PEG by weight) for about 20 minutes. This step rapidly removed the larger chunks of coating material, leaving only a thin layer of aluminide material on the substrate.

Figure 3:
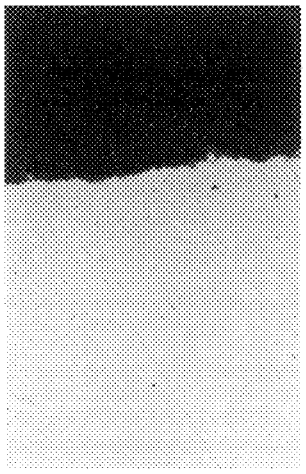
FIG. 3 is a photomicrograph of the cross-section of FIG. 2, after another stage of treatment according to this invention.

FIG. 3 is a photomicrograph of the cross-section of FIG. 2, after the rinsed surface has been gently grit-blasted, as described in the examples. Grit-blasting of less than about 120 seconds resulted in complete removal of the remaining aluminide coating, without any damage to the substrate.

Various embodiments of this invention have been described here. However, this disclosure should not be deemed to be a limitation on the scope of the invention. Accordingly, various modifications, adaptations, and alternatives may occur to one skilled in the art without departing from the spirit and scope of the claimed inventive concept.

All of the patents, articles, and texts mentioned above are incorporated herein by reference.

What is claimed:

1. A method for selectively removing an aluminide-containing coating from the surface of a metal-based substrate, comprising the following steps:

(a) contacting the surface of the substrate with at least one stripping composition to degrade the coating without severely pitting the substrate, wherein the stripping composition is selected from the group consisting of:
(i) aliphatic or aromatic sulfonic acids;
(ii) a solution of an inorganic acid and an organic solvent; and
(iii) sulfuric acid or an aqueous solution of sulfuric acid;

wherein the weight ratio of sulfuric acid to water is in the range of about 10:90 to about 65:35; and then (b) removing the degraded coating without damaging the substrate.

2. The method of claim 1, wherein the stripping composition is an aliphatic or aromatic sulfonic acid and the sulfonic acid is selected from the group consisting of methanesulfonic acid, ethanesulfonic acid, benzene sulfonic acid, toluene sulfonic acid, and naphthalene sulfonic acid.

3. The method of claim 1, wherein the stripping composition is an aliphatic or aromatic sulfonic acid and the sulfonic acid is methanesulfonic acid.

4. The method of claim 1, wherein the stripping composition is a solution of an inorganic acid and an organic solvent and the inorganic acid of component a(ii) is selected from the group consisting of hydrochloric acid, nitric acid, and perchloric acid.

5. The method of claim 1, wherein the stripping composition is a solution of an inorganic acid and an organic solvent and the weight ratio of inorganic acid to solvent is in the range of about 20:80 to about 80:20.

6. The method of claim 1, wherein the stripping composition is a solution of an inorganic acid and an organic solvent and the solvent is selected from the group consisting of aliphatic alcohols, aromatic alcohols, chlorinated alcohols, ketones, nitrile-based solvents, nitrated hydrocarbon solvents, nitrated aromatic solvents, chlorinated hydrocarbon solvents, amines, and mixtures of any of the foregoing.

7. The method of claim 6, wherein the aliphatic alcohol is selected from the group consisting of methanol, ethanol, isopropanol, and mixtures of any of the foregoing.

8. The method of claim 6, wherein the aromatic alcohol is selected from the group consisting of phenols and substituted phenols.

9. The method of claim 7, wherein the stripping composition is a solution of an inorganic acid and an organic solvent and comprises a mixture of hydrochloric acid and ethanol.

10. The method of claim 9, wherein the weight ratio of hydrochloric acid to ethanol is in the range of about 35:65 to about 65:35.

11. The method of claim 1, wherein the weight ratio of sulfuric acid to water is in the range of about 15:85 to about 40:60.

12. The method of claim 1, wherein the stripping composition further comprises a wetting agent.

13. The method of claim 12, wherein the wetting agent is selected from the group consisting of polyalkylene glycols, glycerol, fatty acids, soaps, emulsifiers, and surfactants.

14. The method of claim 13, wherein the wetting agent is present at a level in the range of about 0.1% by weight to about 5% by weight, based on the total weight of the composition.

15. The method of claim 1, wherein the stripping composition further comprises at least one additive selected from the group consisting of inhibitors and oxidizing agents.

16. The method of claim 1, wherein the substrate is immersed in a bath of the stripping composition in step (a).

17. The method of claim 16, wherein the bath is maintained at a temperature below about 170° F. (77° C.) while the substrate is immersed therein.

18. The method of claim 17, wherein the bath is maintained at a temperature below about 130° F. (54° C.) while the substrate is immersed therein.

19. The method of claim 16, wherein the immersion time is in the range of about 15 minutes to about 400 minutes.

20. The method of claim 16, wherein the immersion time is less than about 150 minutes.

21. The method of claim 1, wherein the degraded coating is removed in step (b) by abrading the surface.

22. The method of claim 21, wherein the surface is abraded by a light grit-blasting.

23. The method of claim 22, wherein the grit-blasting is carried out by directing a pressurized air stream containing abrasive particles across the surface at a pressure of less than about 40 psi.

24. The method of claim 23, wherein the average particle size for the abrasive particles is less than about 500 microns.

25. The method of claim 1, wherein the degraded coating is removed in step (b) by agitating the substrate in an aqueous bath.

26. The method of claim 1, wherein the substrate is contacted with a rinsing composition between step (a) and step (b).

27. The method of claim 26, wherein the rinsing composition comprises water and a wetting agent.

28. The method of claim 27, wherein the wetting agent is a polyalkylene glycol, and is present at a level of about 0.1% to about 5% by weight, based on the total weight of the rinsing composition.

29. The method of claim 26, wherein contact with the rinsing composition is carried out by immersing the substrate in a bath of the rinsing composition for about 1 minute to about 30 minutes.

30. The method of claim 1, wherein step (a) comprises contacting the substrate surface with a first stripping composition, and then contacting the substrate surface with a second stripping composition.

31. The method of claim 30, wherein the first stripping composition comprises a mixture selected from the group consisting of (I) hydrochloric acid and an aliphatic alcohol, and (II) sulfuric acid and water.

32. The method of claim 30, wherein the second stripping composition comprises water and an alkane sulfonic acid.

33. The method of claim 1, wherein the aluminide-containing material comprises at least one compound selected from the group consisting of aluminide, platinum aluminide, nickel aluminide, platinum-nickel aluminide, refractory-doped aluminides, and alloys which contain at least one of the foregoing.

34. The method of claim 1, wherein the metal-based substrate is a nickel-based superalloy or a cobalt-based superalloy.

35. A method for selectively removing an aluminide-containing coating from the surface of a superalloy substrate, comprising the following steps:

(a) contacting the surface of the substrate with at least one stripping composition to degrade the coating without severely pitting the substrate, wherein the stripping composition is selected from the group consisting of:
  (i) aliphatic or aromatic sulfonic acids;
  (ii) a solution of an inorganic acid and an organic solvent; and
  (iii) sulfuric acid or an aqueous solution of sulfuric acid, wherein the weight ratio of sulfuric acid to water is in the range of about 10:90 to about 65:35;

(b) contacting the surface with a rinsing composition which comprises water; and then (c) abrading the surface to remove the degraded coating without damaging the substrate.

36. The method of claim 35, wherein the stripping composition comprises methane sulfonic acid or a mixture of hydrochloric acid and an alcohol.

* * * * *